US008695466B2

(12) United States Patent
Guarini

(10) Patent No.: US 8,695,466 B2
(45) Date of Patent: Apr. 15, 2014

(54) APPARATUS AND METHOD FOR COOLING THE CUTTING MEANS IN PAPER LOGS CUTTING MACHINES

(75) Inventor: Ciro Guarini, Calcinaia (IT)

(73) Assignee: Futura S.p.A., Capannori (LU) Fraz. Guamo (IT)

( * ) Notice: Subject to any disclaimer, the term of this patent is extended or adjusted under 35 U.S.C. 154(b) by 800 days.

(21) Appl. No.: 12/519,856

(22) PCT Filed: Nov. 20, 2007

(86) PCT No.: PCT/IT2007/000815

§ 371 (c)(1),
(2), (4) Date: Jun. 18, 2009

(87) PCT Pub. No.: WO2008/078347

PCT Pub. Date: Jul. 3, 2008

(65) Prior Publication Data

US 2009/0308216 A1 Dec. 17, 2009

(30) Foreign Application Priority Data

Dec. 27, 2006 (IT) ..... FI2006A0338

(51) Int. Cl.
*B26D 1/16* (2006.01)

(52) U.S. Cl.
USPC ..... 83/16; 83/169; 83/171; 83/490

(58) Field of Classification Search
USPC ..... 83/169, 171, 16, 490, 471.1, 54
See application file for complete search history.

(56) References Cited

U.S. PATENT DOCUMENTS

| | | | | | |
|---|---|---|---|---|---|
| 1,648,938 | A | * | 11/1927 | Dietrich | 34/428 |
| 1,988,243 | A | * | 1/1935 | Johnson | 83/471.1 |
| 2,163,687 | A | * | 6/1939 | Jacobsen | 451/53 |
| 2,300,431 | A | * | 11/1942 | Murray | 125/37 |
| 2,822,844 | A | * | 2/1958 | Busch | 241/101.2 |
| 3,112,780 | A | * | 12/1963 | Lecrone | 83/873 |
| 3,267,974 | A | * | 8/1966 | Elson | 30/377 |
| 3,538,802 | A | * | 11/1970 | Helm et al. | 83/411.6 |
| 3,661,045 | A | * | 5/1972 | Mermelstein | 83/676 |
| 3,816,875 | A | | 6/1974 | Duncan et al. | |
| 3,905,260 | A | | 9/1975 | Nystrand | |
| 4,041,587 | A | * | 8/1977 | Kraus | 29/25.42 |
| 4,230,005 | A | * | 10/1980 | Varga | 83/100 |
| 4,676,557 | A | * | 6/1987 | Shope et al. | 299/39.3 |
| 6,009,782 | A | * | 1/2000 | Tajima et al. | 83/99 |
| 6,925,917 | B2 | * | 8/2005 | Tilley et al. | 83/15 |
| 2001/0022126 | A1 | * | 9/2001 | Gambini | 83/471.2 |
| 2005/0284277 | A1 | * | 12/2005 | Casella et al. | 83/488 |
| 2011/0048200 | A1 | * | 3/2011 | Ide et al. | 83/169 |

FOREIGN PATENT DOCUMENTS

| | | |
|---|---|---|
| EP | 0 982 104 | 3/2000 |
| IT | WO 2006/126226 | 11/2006 |

* cited by examiner

*Primary Examiner* — Kenneth E. Peterson
(74) *Attorney, Agent, or Firm* — McGlew and Tuttle, P.C.

(57) ABSTRACT

An apparatus for cooling the cutting device of paper logs cutting machines including a channel (60) surrounding the cutting device, in which channel a cooling fluid is injected, the cooling fluid being confined inside the channel.

12 Claims, 3 Drawing Sheets

APPARATUS AND METHOD FOR COOLING THE CUTTING MEANS IN PAPER LOGS CUTTING MACHINES

The present invention relates to an apparatus and method for cooling the cutting means in logs cutting machines.

It is known that logs cutting machines are used in the paper converting industry to subdivide paper logs into rolls whose length is less than that of the paper logs, i.e. into marketable standard paper rolls. The subdivision of the paper logs is carried out by means of cuts executed orthogonally to their longitudinal axis.

A conventional logs cutting machine comprises a bearing platform provided with guide channels along which the one or more paper logs to be cut are positioned, means for intermittently advance the paper logs along said guide channels, a retaining unit for retaining the paper logs during cutting, and cutting means with a blade mounted on a rotating arm. In practice, each paper log is made to advance along the respective guide channel and stopped in a position apt to execute the cut in correspondence to the retaining unit. Examples of cutting machines working according to this operative scheme are disclosed in EP 982104, WO 2006/126226 and U.S. Pat. No. 3,905,260.

During the very cutting step, the blade is subject to heating and it is consequently subject to deformations which imply undesired vibrations of the same, so that the cut of the paper log is not perfect.

In order to reduce at the minimum the negative effects of the blade heating, several cooling systems are adopted.

A known cooling method consists in cooling the entire cutting station, which is enclosed in a safety box provided to avoid the entrance of the human operators within the blade operating area. This method implies high energy consumption, thus resulting not compatible with the current production needs, since the cooling involves not only the blade but all the space delimited by the safety cabin.

Another known cooling method consists in providing a series of nozzles on the blade-holding arm, the nozzles being destined to inject air on the blade surface to obtain its cooling. This solution is quite complex from a mechanical point of view.

The main aim of the present invention is to provide a very simple, efficient and cheap cooling system.

These results have been achieved, according to the present invention, by providing an apparatus and a method having the features described in the independent claims. Further features of the present invention are the subject of the dependent claims.

Thanks to the present invention, it is possible to provide for the cooling of the cutting means in a more efficient way, with simple, cheap and reliable apparatus, ensuring reduced energy consumption and a high working regularity. Furthermore, the blade surface portion instantaneously subject to cooling is relatively high.

These and further advantages and characteristics of the present invention will be best understood by anyone skilled in the art from a reading of the following description in conjunction with the attached drawings, given as a practical exemplification of the invention, but not to be considered in a limitative sense, wherein.

Figure 1:
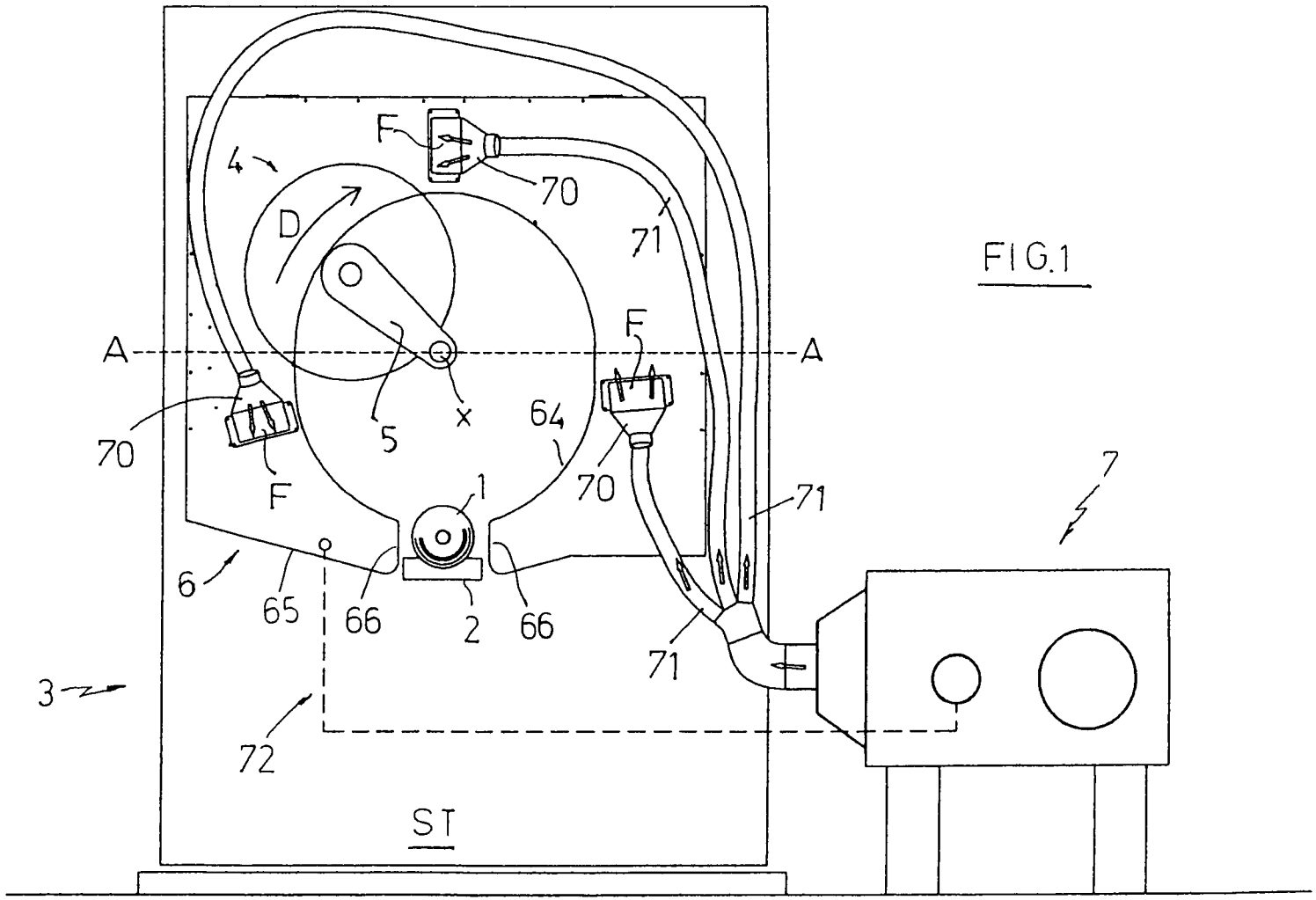
FIG. 1 is a schematic front view of a paper cutting machine in correspondence to the cutting station, wherein the cutting means comprise an orbital blade.
Figure 3:
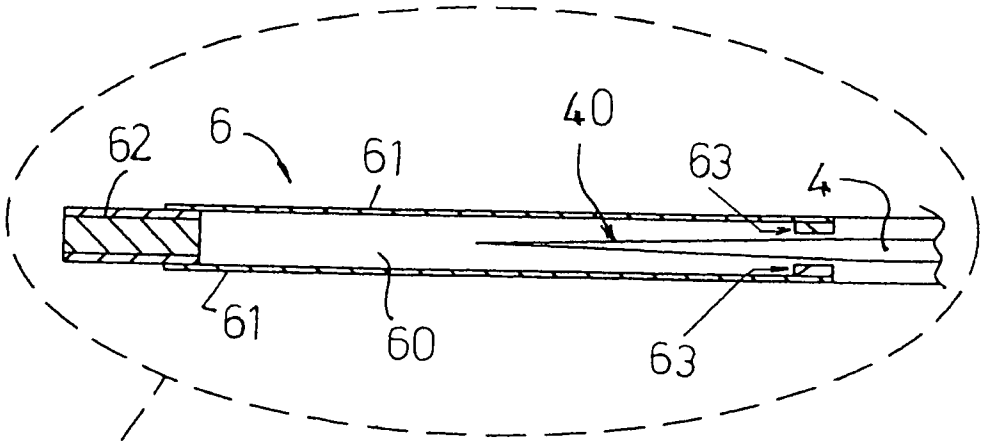
FIG. 3 is an enlarged detail of FIG. 3.
Figure 2:
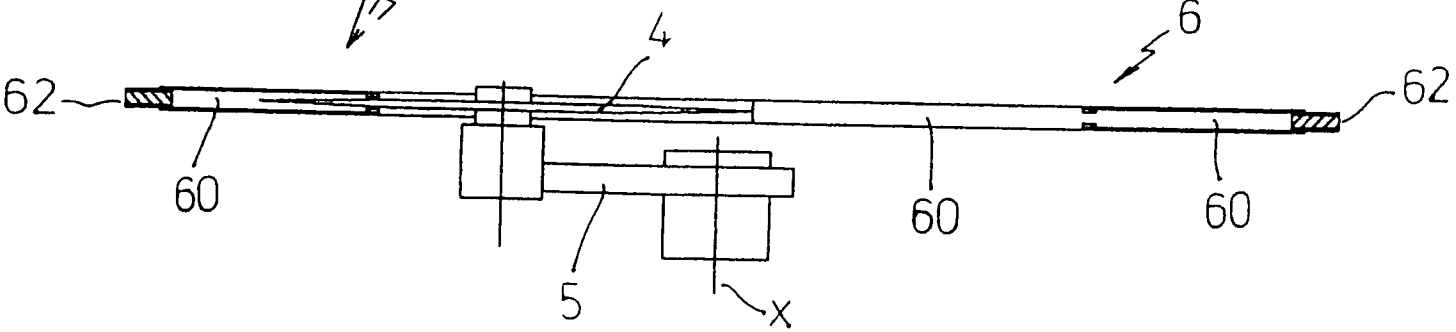
FIG. 2 is a schematic section view along line A-A of FIG. 1.

An apparatus according to the present invention can be used, for example, in a paper logs cutting machine comprising means for guiding and advancing the logs (1) on a bearing horizontal base or platform (2), and cutting means, disposed and acting in a respective station (ST) of the machine (3) to cut each log orthogonally to the longitudinal axis thereof. In the example shown in FIG. 1 said cutting means comprise an orbital blade (4) mounted on an arm (5) which moves the blade (4) along a circular path having a predetermined radius. At each revolution of the blade (4), the latter intercepts a log (1) retained in the cutting station (ST) by a retaining mechanism (not shown in the drawings), thus cutting the log orthogonally to its longitudinal axis. After each cut, the log (1) is advanced along the platform (2) to push forward the small roll thus obtained and to prepare the same log to the subsequent cut. A paper logs cutting machine of this type is known to those skilled in the art of paper converting.

Therefore, it is not described in further details. An apparatus according to the present invention comprises a structure (6) whose walls delimit a space (60) which surrounds the path followed by the blade (4) and in which a cooling fluid is injected.

In practice, according to the example shown in the appended drawings, the said structure (6) is made by a carter with a lower interruption (to allow the positioning of the paper logs in the cutting position) which surrounds the blade (4) when the latter rotates about the axis (x) of the arm (5), thus delimiting a space surrounding the path of the blade (4) driven by the arm (5), in which space a cooling fluid is injected.

Figure 4:
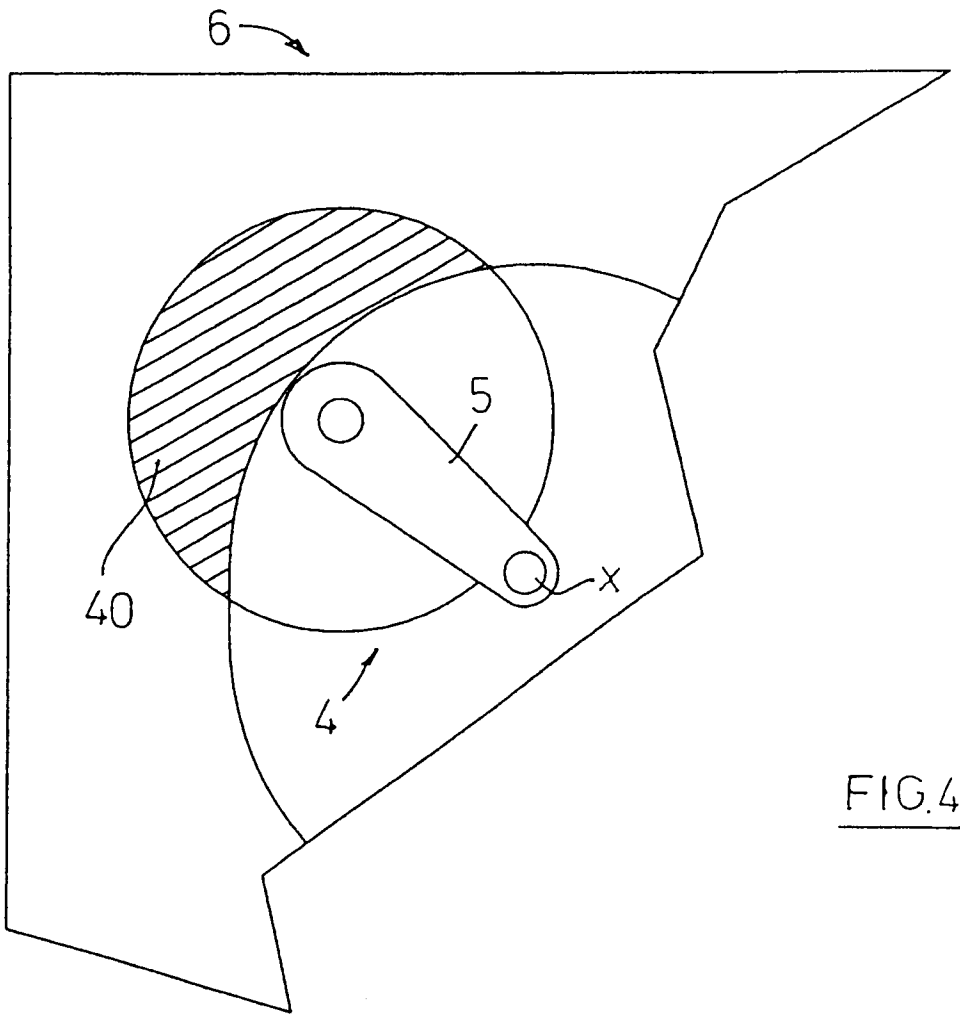
FIG. 4 is an enlarged detail of FIG. 4, wherein the dashed area represents the blade surface portion instantaneously subject to cooling.

In other words, the said structure (6) delimits a channel inside which a cooling fluid is injected, the cooling fluid being thus confined close to the path followed by the blade (4). There is always a portion of the blade (4) inside the said channel. In FIG. 4 the dashed part (40) represents the surface portion of the blade (4) instantaneously subject to cooling. It is noted that there is always a relevant part (40) of the blade (4) subject to the action of the cooling fluid confined in the space surrounding the blade (4) along the path followed by the latter.

With reference to the example shown in the appended drawings, the said structure (6) comprises two side walls (61) oriented parallel to the blade (4) and to the path followed by the same blade, a peripheral edge (62) interrupted in correspondence to the platform (2), i.e. interrupted in correspondence to a zone where the logs are in the cutting position, and, on the inner side of each side wall (61), an appendix (63) which is oriented towards the inside of the structure itself and which locally reduces the transverse section of the structure without contacting the respective flank of the blade. In this way, the cooling fluid can exit from the channel-shaped space (60) flowing between the flanks of the blade (4) and the said appendixes (63). As shown in FIG. 1, each of said walls (61) has a curvilinear inner side (64) whose radius is equal to the length of the arm (5) supporting the blade (4), said inner side (64) being interrupted on its lower part to allow the correct positioning of the logs (1) to be cut on the platform (2). The said inner side (64) is prolonged downwardly by a substantially vertical portion (66) of the wall (61) connecting it with the external side (65) of the same wall (61). In practice, each wall (61) features an external side (65) surrounding the circular path followed by the blade (4) moved by the arm (5), an internal concave side (64) enclosing the area within which the arm (5) rotates, and portion (66) connecting the said external and internal sides, said portion (66) being lateral to the platform (2). The concavity of the said inner side (64) faces the platform (2), i.e. the logs (1) positioned on the latter. While rotating about the axis (x), the arm (5) moves within an area which is peripherally delimited by the curvilinear sides (64) of the walls (61) and, in part, by the platform (2). Since the blade (4) is mounted on the free end of the arm (5), a portion (40) of the blade (4) always moves within the cooled channel-shaped space (60) delimited by the walls (61).

In FIG. 1 the arrow "D" denotes the rotation of the arm (5).

For example, the cooling fluid can be air coming from a cooling unit (7) and injected in the space (60) through a plurality of sleeves (70) connected to the cooling unit (7) through respective conduits (71).

The cooling unit (7) can be of any type available on the market.

In FIG. 1 the arrows "F" denote the flow of the cooling air entered in the space (60) delimited by the structure (6). As shown in the same scheme, the cooling fluid can be entered in the space (60) directing it against the blade (4) moved by the arm (5).

A fluid return line can be provided, connecting the space (60) with the cooling unit (70) through a respective conduit (72).

An operative method according to the present invention provides for the cooling of the blade used to cut the paper logs by injecting a cooling fluid in a confined space surrounding the path followed by the blade.

Thanks to the present invention, the blade (4) moves within a cooled space whose small dimension implies a reduced energy consumption.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent.

The invention claimed is:

1. An apparatus, comprising:

a cutting means for cutting at least one paper log, the cutting means moving along a predetermined path, said cutting means comprising a blade and an arm, said arm being rotatable about a first stationary axis, said blade being rotatably connected to said arm such that said blade rotates, relative to said arm, about a second moving axis of said arm while the arm rotates about the first axis;

a structure defining an interior periphery substantially centered around said first axis of said arm, said interior periphery extending substantially all the way around said first axis of said arm except where a paper log is held to be cut, said structure defining a channel extending along said interior periphery of said structure and extending radially away from said first axis of said arm, said arm moving about said interior periphery of said structure with said blade projecting into said channel;

a cooling unit for injecting cooling fluid into a cooling area inside said channel to cool said blade, wherein narrow gaps between said blade and channel side walls permit the cooling fluid to exit, said cooling unit including a plurality of sleeves connected to said structure, said cooling fluid being injected in to said channel via at least said plurality of sleeves.

2. An apparatus according to claim 1, wherein said channel exhibits an exit section for the cooling fluid, said cooling fluid being delivered to said structure via conduits and sleeves, each of said sleeves being connected to one of said conduits, each of said conduits having a conduit diameter, each of said sleeves having a sleeve diameter, said sleeve diameter being greater than said conduit diameter, said structure defining a housing having said channel, said channel having a dimension that is greater than a width of said blade, said blade having a first blade side surface and a second blade side surface, said housing having a first housing inner surface and a second housing inner surface, said first housing inner surface being opposite said second housing inner surface, at least a portion of said first blade side surface being adjacent to said first housing inner surface, at least a portion of said second blade side being adjacent to said second housing inner surface.

3. An apparatus according to claim 1, further comprising:

a first appendix; and a second appendix, wherein the cooling fluid is air coming from an air cooling unit which is injected in said channel by means of said sleeves connected to the cooling unit by means of respective conduits, said sleeves having a dimension that is greater than a dimension of said conduits, wherein said cooling area extends continuously in a circumferential direction from a first position to a second position, said first position being adjacent to a first side of a log conveying platform, said second position being adjacent to a second side of the log conveying platform, said first side being opposite said second side, said air cooling unit being located at a spaced location from the paper logs cutting machine, each of said sleeves being connected to said cooling unit via one of said conduits, each of said conduits extending between said cooling unit and one of said sleeves, each of said sleeves engaging said structure, said structure comprising a housing, said housing having a first housing inner surface and a second housing inner surface, said first appendix engaging at least a portion of said first housing inner surface, said second appendix engaging at least a portion of said second housing inner surface, said first housing inner surface, said second housing inner surface, said first appendix and said second appendix defining said channel, said first appendix and said second appendix being adjacent to said blade.

4. An apparatus according to claim 3, wherein said plurality of sleeves includes a first sleeve, a second sleeve and a third sleeve, said first sleeve being opposite said second sleeve, said conduits comprising a first conduit, a second conduit and a third conduit, said third sleeve being at a position located above said first sleeve and said second sleeve, said first sleeve and said first conduit delivering a first flow of cooling fluid to a first portion of said channel, said second sleeve and said second conduit delivering a second flow of cooling fluid to a second portion of said channel, said third sleeve and said third conduit delivering a third flow of cooling fluid to a third portion of said channel conduit, wherein a continuous flow of cooling fluid is supplied to said channel via said cooling unit, said first sleeve, said second sleeve, said third sleeve, said first conduit, said second conduit and said third conduit.

5. An apparatus according to claim 4, wherein a portion of said blade is always inside said channel.

6. An apparatus according to claim 5, wherein a lateral surface of each side of said blade and a leading edge of said blade engage said cooling area in said channel.

7. A method for cooling a cutting means of paper logs cutting machines, the method comprising:

providing a blade connected to an arm, said arm rotating about a stationary first arm axis, said blade rotating about a second arm axis of said arm;

providing a structure defining an interior periphery substantially centered around said first axis of said arm, said interior periphery extending substantially all the way around said first axis of said arm except where a paper log is held to be cut, said structure defining a channel extending along said interior periphery of said structure and extending radially away from said first axis of said arm;

providing a plurality of sleeves;

moving said arm about said first arm axis such that said arm moves about said internal periphery of said structure with said blade projecting into said channel, wherein said blade is moved based on movement of said arm;

cooling of said blade by injecting a cooling fluid in a space surrounding a path followed by the blade, said space being defined by said structure, said cooling fluid in said space defining a cooling region, wherein at least a portion of the blade is arranged in said space and extends in said cooling region, wherein narrow gaps between said blade and channel side walls permit the cooling fluid to exit, said cooling fluid being injected in to said space via at least said plurality of sleeves.

8. A method according to claim 7, wherein the cooling fluid is injected in said confined space against the direction followed by the blade.

9. A method according to claim 7, further comprising:

providing a plurality of conduits, each of said conduits having a conduit diameter, each of said sleeves being in communication with one of said sleeves, each of said sleeves having a sleeve width, said sleeve width being greater than said conduit diameter;

providing a log conveying platform;

providing a cooling unit, said cooling unit being located at a spaced location from said log conveying platform, each of said sleeves being connected to said cooling unit via one of said conduits, each of said conduits extending between said cooling unit and one of said sleeves, each of said sleeves engaging said structure, said cooling region extending continuously in a circumferential direction from a first position to a second position with respect to a longitudinal direction of the log conveying platform, said first position being adjacent to a first side of said log conveying platform, said second position being adjacent to a second side of said log conveying platform, said first side being opposite said second side.

10. A method according to claim 9, wherein said plurality of sleeves include a first sleeve, a second sleeve and a third sleeve, said first sleeve being opposite said second sleeve, said conduits comprising a first conduit, a second conduit and a third conduit, said third sleeve being at a position located above said first sleeve and said second sleeve, said first sleeve and said first conduit delivering a first flow of cooling fluid to a first portion of said channel, said second sleeve and said second conduit delivering a second flow of cooling fluid to a second portion of said channel, said third sleeve and said third conduit delivering a third flow of cooling fluid to a third portion of said channel conduit, wherein a continuous flow of cooling fluid is supplied to said channel via said cooling unit, said first sleeve, said second sleeve, said third sleeve, said first conduit, said second conduit and said third conduit.

11. A method according to claim 10, wherein a portion of said blade is always inside said channel.

12. An method according to claim 11, further comprising:

a first appendix; and a second appendix, wherein a lateral surface of each side of said blade and a leading circumferential edge of said blade engage said cooling area in said channel, said structure comprising a housing, said housing having a first housing inner surface and a second housing inner surface, said first appendix engaging at least a portion of said first housing inner surface, said second appendix engaging at least a portion of said second housing inner surface, said first housing inner surface, said second housing inner surface, said first appendix and said second appendix defining said channel, said first appendix and said second appendix being adjacent to said blade.

* * * * *